US005878898A

United States Patent [19]

Shefflin

[11] Patent Number: 5,878,898

[45] **Date of Patent: *Mar. 9, 1999**

[54] PROTECTIVE OVERCAP ASSEMBLY FOR FLUID CONTAINERS

[76] Inventor: Joanne Shefflin, 850 Highland Ave., Piedmont, Calif. 94611

[ * ] Notice: This patent issued on a continued prosecution application filed under 37 CFR 1.53(d), and is subject to the twenty year patent term provisions of 35 U.S.C. 154(a)(2).

[21] Appl. No.: 603,049

[22] Filed: Feb. 16, 1996

Related U.S. Application Data

[63] Continuation-in-part of Ser. No. 301,140, Sep. 6, 1994, abandoned, which is a continuation-in-part of Ser. No. 93,381, Jul. 19, 1993, abandoned, which is a continuation-in-part of Ser. No. 961,103, Oct. 14, 1992, abandoned.

[51] Int. Cl.[6] ..... A61J 9/08; A61J 11/04; B65D 41/62; B65D 47/00

[52] U.S. Cl. ..... 215/11.6; 215/11.1; 215/229; 215/307; 220/708; 220/815

[58] Field of Search ..... 215/11.1, 11.4, 215/11.5, 11.6, 229, 307; 220/708, 815; 222/559, 549

[56] References Cited

U.S. PATENT DOCUMENTS

| | | | |
|---|---|---|---|
| 976,887 | 11/1910 | Ladley | 215/11.6 |
| 1,018,831 | 2/1912 | Ladley | 215/11.6 |
| 1,312,544 | 8/1919 | Johnson | 215/100 R X |
| 2,075,249 | 3/1937 | Wilson | 215/11.6 X |
| 2,090,749 | 8/1937 | Corsi et al. | 215/11.1 X |
| 2,424,629 | 7/1947 | Patterson | 215/11.1 |
| 2,471,172 | 5/1949 | Stoller | 215/11.1 |
| 2,516,040 | 7/1950 | Zumdahl | 215/307 X |
| 2,588,991 | 3/1952 | Schellin | 215/11.1 |
| 2,694,500 | 11/1954 | White | 215/11.1 |
| 2,834,496 | 5/1958 | Boston et al. | 215/11.1 |
| 2,948,440 | 8/1960 | Barravecchia | 215/307 X |
| 3,289,874 | 12/1966 | Dailey et al. | 215/11.6 |
| 3,294,293 | 12/1966 | Johns | 215/307 X |
| 3,301,423 | 1/1967 | Soto | 215/11.6 |
| 3,339,771 | 9/1967 | Ballin | 215/11.6 |
| 3,393,817 | 7/1968 | Meierhoefer | 215/11.6 X |
| 3,572,533 | 3/1971 | Koll | 215/11.6 |
| 3,604,952 | 9/1971 | Mac Donald | 215/11.1 |
| 3,613,761 | 10/1971 | Moody | 215/11.6 X |
| 3,782,578 | 1/1974 | Ballin | 215/11.6 X |
| 4,620,638 | 11/1986 | Schmidt | 215/11.1 |
| 4,700,856 | 10/1987 | Campbell et al. | 215/11.6 X |
| 4,739,906 | 4/1988 | LoTurco | 222/153 |
| 4,830,251 | 5/1989 | Conrad | 215/11.6 X |
| 4,865,228 | 9/1989 | Landecker | 222/153 |
| 4,898,290 | 2/1990 | Cueto | 215/11.1 |
| 4,898,291 | 2/1990 | Sailors | 215/11.1 |
| 4,898,292 | 2/1990 | VerWeyst et al. | 215/327 |
| 4,898,293 | 2/1990 | Morel | 215/250 |
| 4,941,580 | 7/1990 | Julian | 215/235 |
| 4,974,735 | 12/1990 | Newell et al. | 215/235 X |
| 4,991,730 | 2/1991 | Pehr | 215/215 |
| 5,088,612 | 2/1992 | Storar et al. | 215/247 |
| 5,150,801 | 9/1992 | Held | 215/11.1 X |
| 5,269,426 | 12/1993 | Morano | 215/11.6 |
| 5,314,084 | 5/1994 | Folta et al. | 215/307 X |

FOREIGN PATENT DOCUMENTS

| | | | |
|---|---|---|---|
| 488600 | 12/1952 | Canada | 215/301 |
| 61868 | 10/1982 | European Pat. Off. | 215/11.6 |
| 2603187 | 3/1988 | France | 215/11.6 |
| 40542197 | 2/1993 | Japan | 215/11.6 |
| 302733 | 1/1955 | Switzerland | 215/11.1 |
| 951553 | 3/1964 | United Kingdom | 215/307 |
| 2168958 | 7/1986 | United Kingdom . | |
| 2193193 | 2/1988 | United Kingdom . | |

*Primary Examiner*—Sue A. Weaver
*Attorney, Agent, or Firm*—Townsend and Townsend and Crew LLP

[57] ABSTRACT

An overcap assembly for a fluid container (12), such as a baby bottle, protects the nipple (14), or other fluid dispenser, from contamination and from leaking when the overcap (18) is in the protective, covering position. The overcap has an opening (41) in its top through which the nipple extends once a lid (43) has been removed and the overcap has been shifted from a stable protective position surrounding the nipple to a stable enabling position exposing the nipple for use without removing the overcap from the collar (16). The lid is preferably tethered, hinged or otherwise connected to the overcap.

20 Claims, 7 Drawing Sheets

PROTECTIVE OVERCAP ASSEMBLY FOR FLUID CONTAINERS

CROSS REFERENCE TO RELATED APPLICATIONS

This application is a continuation-in-part of patent application Ser. No. 08/301,140, filed Sep. 6, 1994, entitled PROTECTIVE OVERCAP FOR BABY BOTTLES, now abandoned, which is a continuation-in-part of patent application Ser. No. 08/093,381, filed Jul. 19, 1993, entitled IMPROVED PROTECTIVE OVERCAP FOR BABY BOTTLES, now abandoned, which is a continuation-in-part of patent application Ser. No. 07/961,103, filed Oct. 14, 1992, entitled IMPROVED PROTECTIVE OVERCAP FOR FLUID CONTAINER, now abandoned, the disclosures of which are incorporated by reference.

BACKGROUND OF THE INVENTION

This invention relates to improvements in protective overcaps for fluid containers, such as baby bottles, as well as other fluid containers and, more particularly, to a fluid container having a protective overcap which remains with the container during use.

Baby bottles of the conventional type typically have a protective overcap which is coupled to the container in some manner to cover the nipple on the baby bottle and keep it free of dirt and contamination. An overcap for this purpose is cylindrical in configuration, open at one end and is of a one piece plastic construction. The base or open end of the overcap is generally press fitted on the threaded collar or collar which holds a nipple on the bottle. To use the bottle, the overcap is pulled axially away from the bottle to separate it from the collar, thereby exposing the nipple and allowing the fluid dispenser, namely the baby bottle and nipple, to deliver the liquid contained in the bottle itself.

The disadvantage of conventional overcaps is that they must be removed entirely from the bottle to expose the nipple for use. This separation of the overcap from the bottle causes the overcap to be misplaced, lost, and/or easily broken. At any rate, conventional overcaps present a problem when it is desired to recap a nipple with an overcap. Much time and concern is given as to where the overcap is if it is taken off the bottle. Moreover, even if the whereabouts of the overcap is known, after the bottle has been used, the overcap itself during separation from the bottle may be dirty or contaminated so as to require washing or sterilization before it is placed on the collar/bottle in covering relationship to the nipple once again. The problem is so acute as to give rise to the sale of additional replacement overcaps in packages to users of baby bottles. These overcaps are used as replacements for lost, unclean, or broken overcaps that otherwise are purchased as standard components to a baby bottle assembly.

Because of the foregoing drawbacks, a need exists for improvements in fluid dispensers with overcaps, including but not limited to dispensers, such as baby bottles. The present invention satisfies this need.

SUMMARY OF THE INVENTION

The present invention is directed to an improved overcap and collar assembly in combination with a fluid container of the type having a fluid dispenser and a protective device or overcap for the fluid dispenser. Unique to this device is the way in which the overcap remains attached to the fluid container at all times and does not need to be removed from the container during use but may be removed from the container for cleaning. The basic concept of the present invention is an improved overcap to protect the dispensing portion of a fluid container until ready for use and to remain with the container during use. The overcap moves from a first or an upper, protective position thereof to a second or a lower, enabling, ready-to-use position while uniquely remaining on the fluid container.

Examples of fluid dispensers having a protective device or an overcap of the present invention are baby bottles of various types having fluid dispensing nipples such as but not limited to, standard bottles, bottles with reusable liners, wide mouthed bottles, bottles with unusual shapes and juice cups having a spout. This device or overcap allows for use of the baby bottle to protect the fluid dispensing nipple and prevent leakage until ready for use and then allowing the nipple to be exposed sufficiently for use, all of which is possible while the overcap remains on the container. The overcap can be moved quickly and easily from the protective position to the enabling position and returned again to the protective position as needed.

The overcap of the present invention has two primary functions while it is in the protective position. Firstly, it covers and thereby protects the nipple or fluid dispenser and keeps it clean, the typical reason for overcaps on conventional baby bottles. Secondly, the overcap carries a leakproof closure lid and is separable therefrom yet remains attached by a hinge. This lid closes an opening in the outer end of the overcap and lightly presses down on the hole in the nipple, while it is in relationship to the hole in the overcap and in the closed position, thus preventing the nipple from leaking. The lid is movable from a location closing the opening in the outer end of the overcap, yet it remains connected to the overcap and can be releasably attached to the side of the overcap when the overcap is in either the protective or enable positions thereof. When the lid is removed from covering the opening, it is moved away from the top of the overcap and moved out of the way to the side of the overcap where it can be attached to the side of the overcap or held in a secure manner. Thus, the end opening at the top of the overcap is exposed. This allows the nipple to protrude through the hole when the overcap is moved downward on the collar to the enabling position while the lid remains attached to the overcap itself.

Another possible feature of the lid is a tubular extension or sleeve that can be attached to or integral with the inner surface of the lid. This sleeve applies a light radial force to the tip of the nipple when the overcap is in the protective position and the lid is in covering relationship to the outer end opening of the overcap. This light force effectively closes and seals the hole in the nipple. This sealing action prevents liquids in the bottle from leaking. While this sleeve is found in limited number of conventional overcaps, it is not associated with an overcap in combination with a lid for closing the outer end opening of an overcap nor is it found associated with an overcap that remains with the container during use. Another option is to not use the sleeve; the pressure of the lid lightly but firmly pressing against the hole in the nipple when the lid is in the closed position is effective enough to prevent leaking from the nipple thus this is another method and objective of this invention.

When the baby bottle is to be put into use, the first step is to open the end hole in the overcap by, for example, flipping open the lid and pivoting the lid in either a backwards motion by its hinge or in a swivel or twist when using a swivel type hinge, then snapping the lid against one or more projections on the side of the overcap into a locked-in stationary position or in the case where a spring hinge is used, allowing the lid to spring into a fixed position adjacent to the side of the cap. Removing the lid from the hole at the top of the overcap allows for the next step of a shifting downward telescope like movement of the overcap to a slightly lower position on the collar and moving from the protective position covering the nipple to the enable position exposing the nipple and where the overcap then rests over the collar and upper neck of the bottle. In so moving, the overcap shifts relative to the nipple and exposes the nipple while the overcap remains on the container and while the lid remains removably attached to or adjacent to the side of the overcap.

In a preferred embodiment of the invention, manual pressure is applied to the overcap in an axial manner to push the overcap axially of and downwardly along the collar through a limited distance. This distance is the distance between a first locking location and a second locking location on the collar, the first locking position being defined by a first rib or projection on the inner surface of the overcap which is releasably received in ribs or projections on the collar. The second locking location being defined by the tight fit and by the friction of the overcap sliding down over the collar whereby the rib on the inner surface of the overcap locks in position around the bottom edge of the collar. It is understood and included in this invention that the ribs could be in reverse order, for example, a pair of ribs could be on the overcap and a single rib could be on the collar. It is also understood that other methods of securing the overcap onto the collar could be used.

As the forces are applied axially to the overcap to start it to move to the enable position, the overcap is pushed downwardly to expose the nipple and to rest with a tight fit over the collar. When this occurs, the nipple will move relative to the overcap and into the hole at the outer end of the overcap, thus exposing the nipple for use.

With the present invention, the overcap does not need to be removed from the fluid container or bottle at any time to put the bottle into functional use. Thus, the chances of losing or breaking the overcap are greatly reduced or are substantially eliminated. However, the overcap may be removed from the fluid container at any time for the purpose of cleaning or refilling the container.

The primary object of the present invention is to provide an improved overcap for fluid containers that is shiftably mounted on the container and is movable in a telescopic manner from a first position on the container at which it protects the fluid dispenser portion to a second position on the container at which it enables the fluid dispenser for use in dispensing the fluid therefrom. This overcap differs from conventional overcaps on the types of fluid containers mentioned above as the conventional overcaps must be removed and separated from the fluid container before use, whereas this invention allows the overcap to remain on the container in both the first protective position and the second enabling position.

Another object of the present invention is to provide an overcap on a fluid container having a fluid dispenser portion of the type described and a collar thereon wherein the overcap and the collar have cooperating means for releasably holding or securing the overcap in either the protective or enabling positions yet manual force is all that is needed to shift the overcap between the protective and enabling positions so that even an unskilled person can use the invention without difficulty.

Another object of the present invention is to provide an improved overcap, collar and container assembly which allows the overcap to move between the protective and enabling positions while remaining on the container and while permitting the fluid container-overcap assembly to be disassembled for cleaning or refilling purposes.

Still another object of the present invention is to provide an improved overcap and collar assembly for a fluid container having a fluid dispenser wherein the overcap has a lid for closing a top end opening on the overcap through which a portion of the fluid dispenser projects during the enabling of the fluid dispenser and wherein the lid has the means for sealing the top end opening on the overcap and means for sealing the top end part of the fluid dispenser where there is a hole when the overcap is in the protective position and the lid is in the closed position pressing against the hole in the fluid dispenser to thereby seal the fluid dispenser portion and prevent leakage of fluid from the container.

Other objects of the present invention will become apparent as the following specification progresses, reference being had to the accompanying drawings for an illustration of several embodiments of the invention.

DETAILED DESCRIPTION OF THE PREFERRED EMBODIMENT

Figure 7:
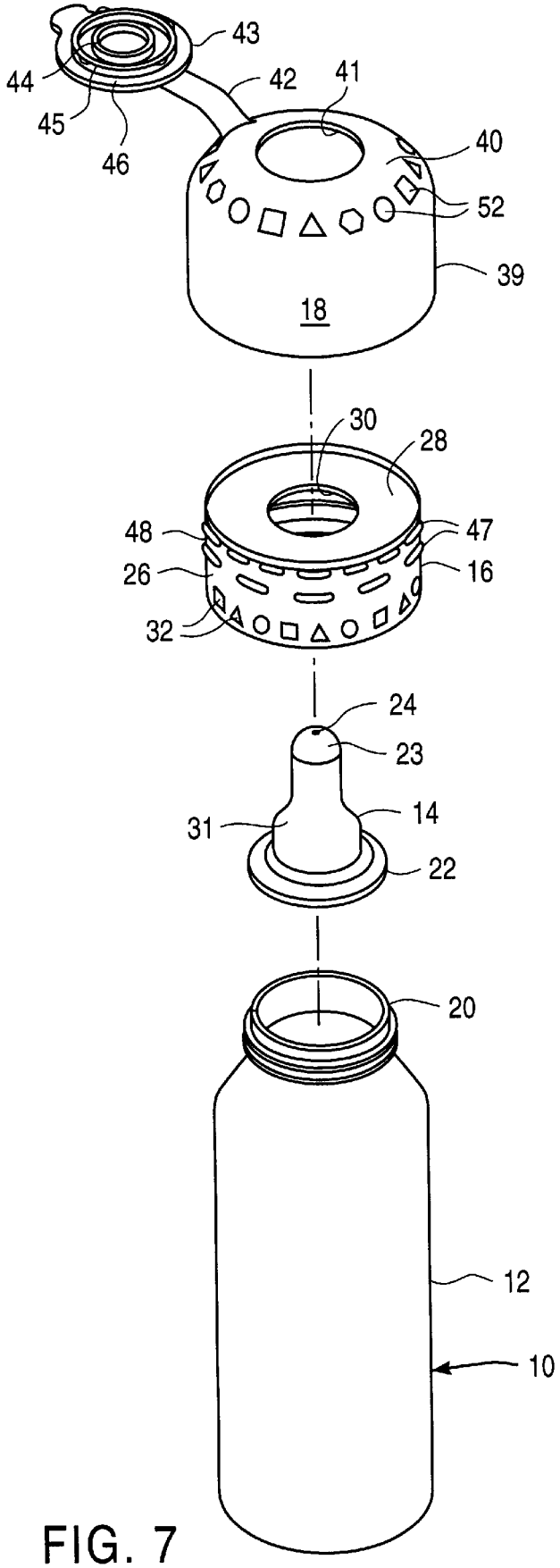
FIG. 7 is an exploded view of a standard baby bottle and a standard nipple and the collar and overcap of the present invention identified as a universal assembly.

A baby bottle assembly of a first embodiment of the present invention is shown in FIG. 7 in an exploded view and is broadly denoted by the numeral 10. Assembly 10 includes a bottle 12, a nipple 14, a threaded collar 16 and an overcap 18. The bottle 12 and nipple 14 of assembly 10 are of standard, conventional construction for most baby bottles. To this end, the bottle 12 has a cylindrical outer surface. Approximately 70–80% of all baby bottles now sold in grocery and drug stores and other locations have this bottle configuration. However, the overcap 18 and the collar 16 of the assembly 10 can be used on a variety of non-conventional shaped bottles as well. Some examples would be, but not limited to, bottles with the following shapes: rectangular, a doughnut shape (such as the ansa bottle), bottles bent on an angle (such as Johnson's Healthflow) and many others of nonstandard shapes. In addition, the overcap 18 and the collar 16 of assembly 10 can be used on bottles and juice cups of different sizes, shapes and diameters by simply enlarging or reducing the size and dimensions of the overcap 18 and the collar 16 to fit the container and the fluid dispenser of any type. Thus, the invention of the overcap and collar included in assembly 10 works on conventional bottles and conventional nipples, as well as non-conventional bottles and nipples, and is considered to be a universal assembly.

Bottle 12 has a neck 20 for receiving the lower flange 22 of nipple 14, the nipple having a tip 23 with one or more holes 24 therethrough, by means of which the liquid from the bottle can be drawn by suction in the mouth of a baby sucking on the nipple.

Collar 16 has a generally cylindrical outer side surface portion 26 and a flat upper portion 28 integral with portion 26 and provided with a hole 30 through which the nipple base 31 can be forced. Design indicia 32 can be placed on the outer surface of collar 16 to provide an aesthetic appearance therefor. Other methods of decoration and aesthetic design could be added to any part of the assembly as shown in FIGS. 15–18. The inner surface of collar 16 is threaded so as to threadably mount the collar on neck 20 of the bottle while nipple 14 projects through opening or hole 30. Other means for securing the collar to the container are possible here.

Figure 10:
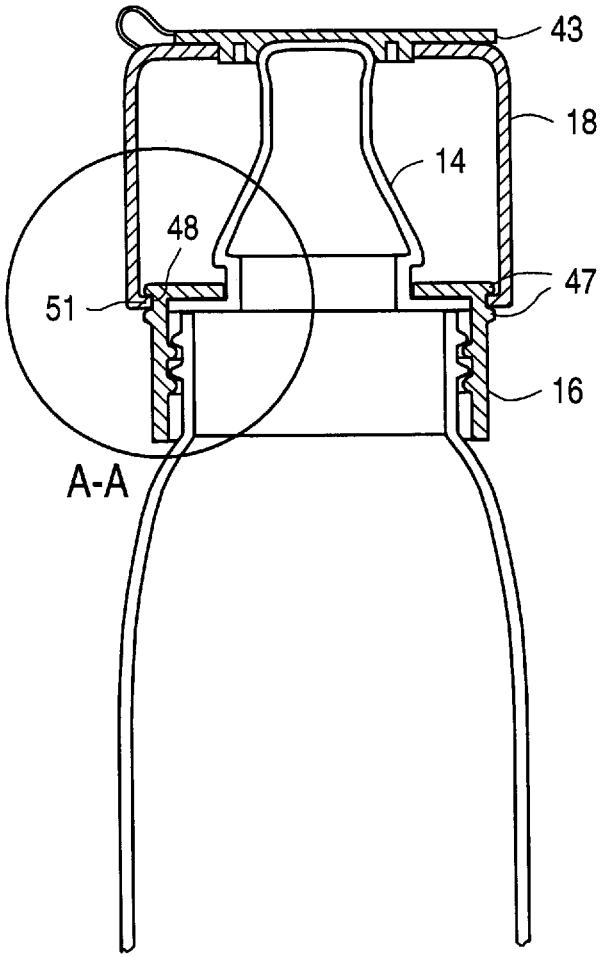
FIG. 10 is a vertical section through the overcap and collar when the overcap is in the covering position and the lid is in contact with the fluid dispenser.

Collar 16 has a number of spaced, circumferentially extending ribs 47 thereon as shown in FIG. 7. These ribs 47 could be solid annular ribs. Other methods of securing the overcap 18 to the collar 16 could be used for frictionally holding the overcap 18 in place mounted on the collar 16 in relationship to the bottle when the overcap is in the first or protective position covering the nipple as shown in FIG. 10.

Figure 13:
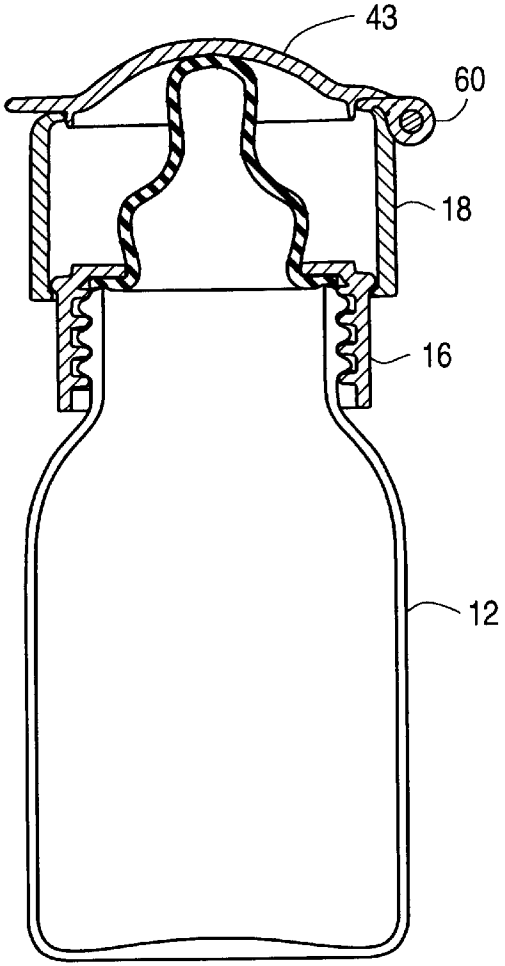
FIG. 13 illustrates the embodiment of FIG. 12 with the overcap raised to the storage position and with the lid pivoted back to cover the overcap opening and seal the hole at the distal end of the nipple.
Figure 12:
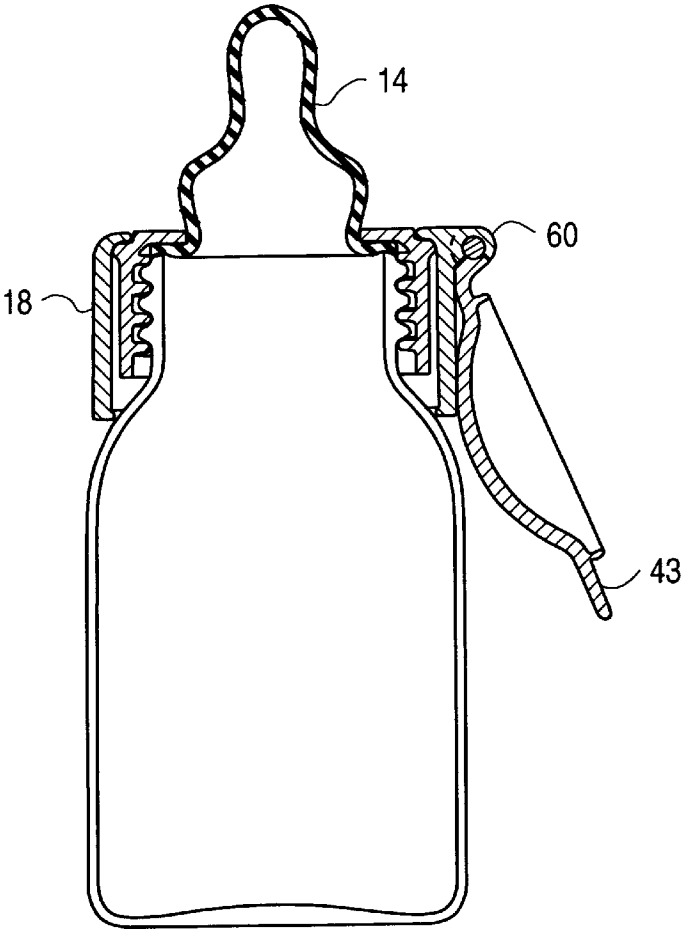
FIG. 12 is a vertical cross-sectional view through an alternative embodiment of the invention shown mounted to a container with a lid spring-hingedly mounted to the overcap and the overcap in the use position exposing the nipple.

Overcap 18 has a cylindrical side wall 39 with a top 40 provided with a central hole 41 therein. A hinge 42 couples the top 40 of the overcap with a lid 43 which can have a pair of annular flanges 44 and 45 on one face 46 of lid 43. Flange 44 has a central recess into which the tip 23 of the nipple 14 extends. This flange 44 frictionally engages the tip 23 and closes the opening 24 in the nipple to prevent leakage. Flange 45 of the lid 43 is to be press-fitted into hole 41 of the overcap to close the opening. At that position the central recess in flange 44 presses against the hole 24 in the nipple and thereby prevents leakage and conceals and protects the nipple 14 within the overcap. The lid 43 as shown in FIGS. 12 and 13 shows another acceptable method of closure without flanges 44 and 45.

Figure 4:
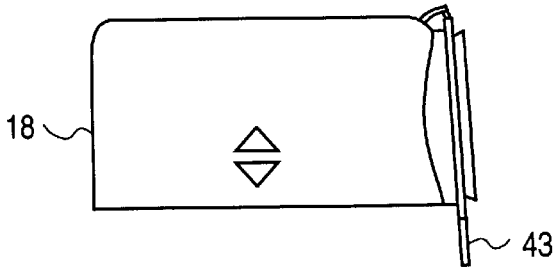
FIG. 4 is a front elevational view of the overcap of FIG. 1 with the lid secured to the side of the overcap.
Figure 2:
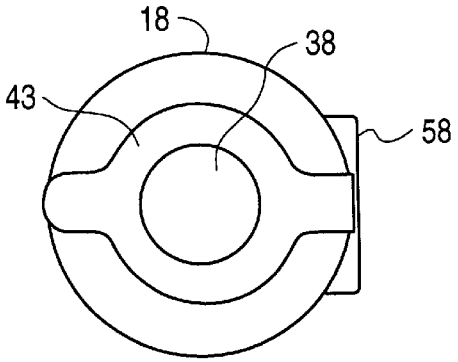
FIG. 2 is a top plan view of the overcap of FIG. 1.
Figure 5:
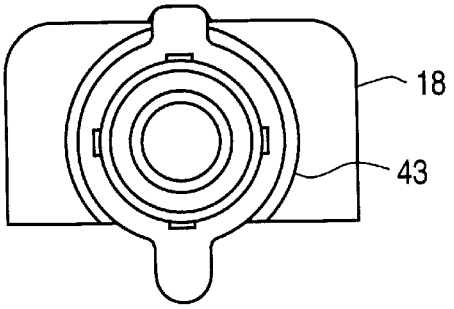
FIG. 5 is a right side elevational view of the overcap of FIG. 4.
Figure 3:
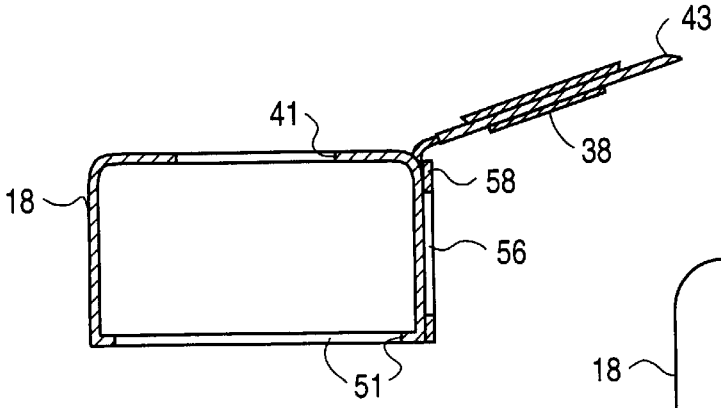
FIG. 3 is a vertical section through the overcap of the present invention with the lid in an opened position.
Figure 6:
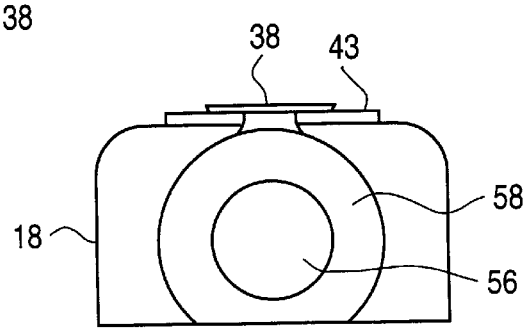
FIG. 6 is a right side elevational view of the overcap of FIG. 1 showing the storage pad.
Figure 16:
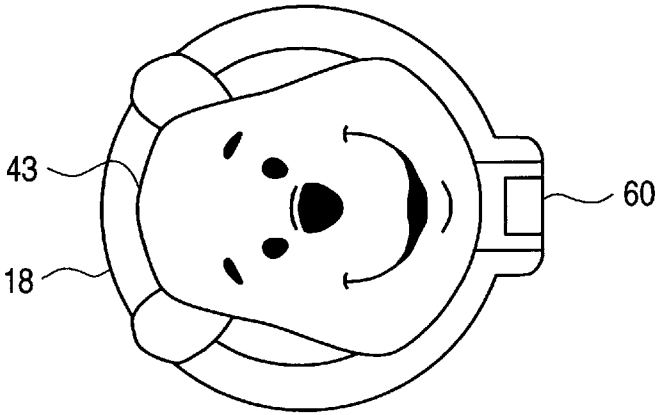
FIGS. 15 and 16 are of an elevation and a top plan view, respectively, showing alternative 3-dimensional character shapes for the lid.
Figure 18:
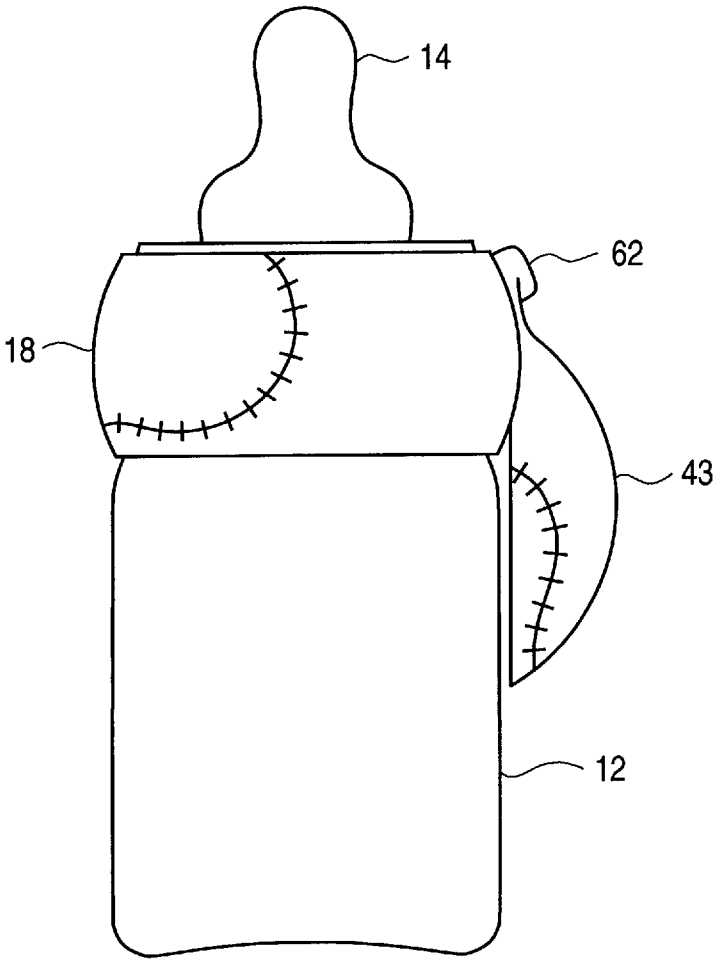
FIGS. 17 and 18 are elevations showing the entire overcap of the present invention can be made into 3-dimensional novelty shapes and FIG. 18 also shows an alternative swivel hinge.
Figure 17:
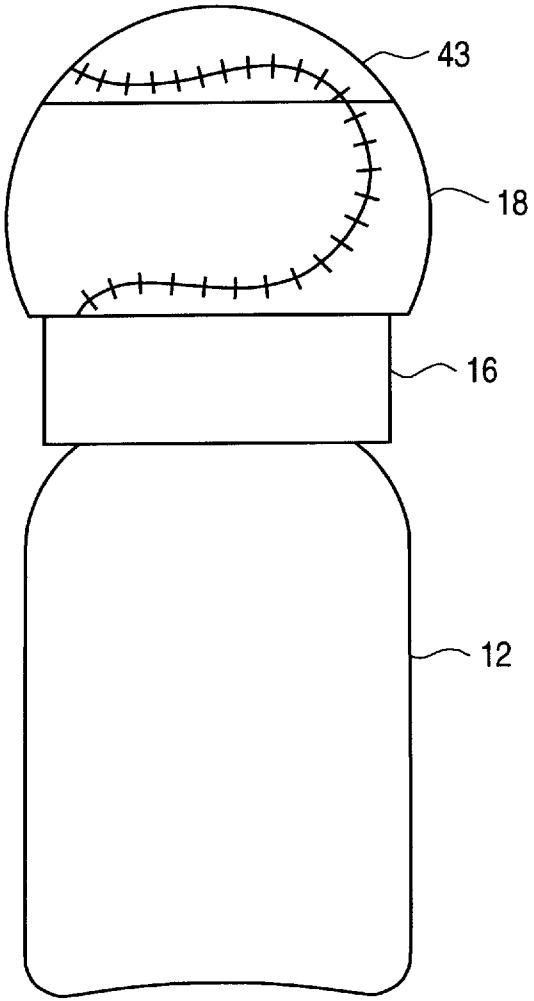

When the lid 43 is opened, it can become coupled to a storing pad 58 on the outer side of the overcap shown in FIGS. 3 and 6. A projection 38 on the top of the lid 43 can be received within a recess 56 on the overcap 18 as shown in FIGS. 3, 4 and 5, the recess 56 being in a storing pad 58 on the overcap. Other methods of storing the lid are shown in FIGS. 12 and 18 whereby the lid is held securely on the side of the overcap 18 by means of a spring hinge or other methods. FIG. 3 shows one type of hinge method where the lid is halfway between the position closing the opening 41 on the top of the overcap and a position in which the normally uppermost surface of the lid is spaced from the storing pad 58 integral with the overcap 18 and against which this type of lid engages. Other acceptable methods for moving the lid 43 away from the top of the overcap 18 to a storage location on the side of the overcap are shown in FIGS. 12, 13, 14 and 18. FIGS. 12–16 show an alternative type hinge 60 such as a spring hinge which holds the lid securely to the side by resistance and FIGS. 17 and 18 show a swivel hinge 62 which holds the lid to the side by another means, it is understood that other hinges could be used to connect the lid 43 to the overcap 18 still other means could be used to hold the lid securely to the side of the overcap as well.

The overcap 18, as shown in FIG. 7, can have decorative symbols 52 on the outer surface. Other methods of decoration and or aesthetic design changes could be added to any part of the assembly without changing the basic functions of the invention as shown in FIGS. 15, 16, 17 and 18.

Figure 1:
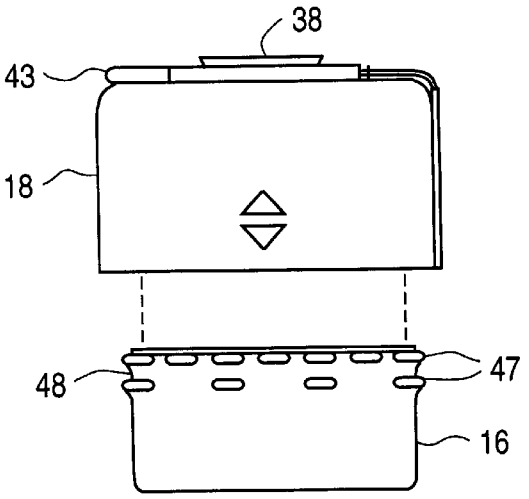
FIG. 1 is a side elevational view of a preferred embodiment of the overcap and the collar of the present invention with the lid in a closed position.
Figure 8:
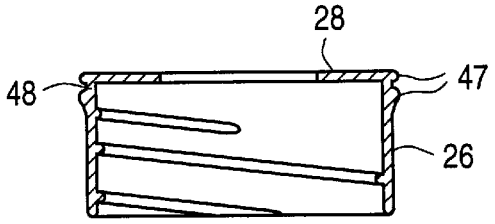
FIGS. 8 and 9 are cross section and top plan views, respectively, of a collar for the overcap of the present invention.
Figure 9:
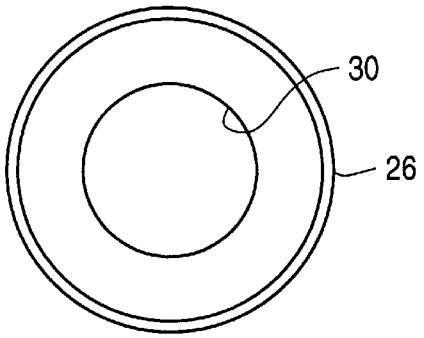
Figure 11:
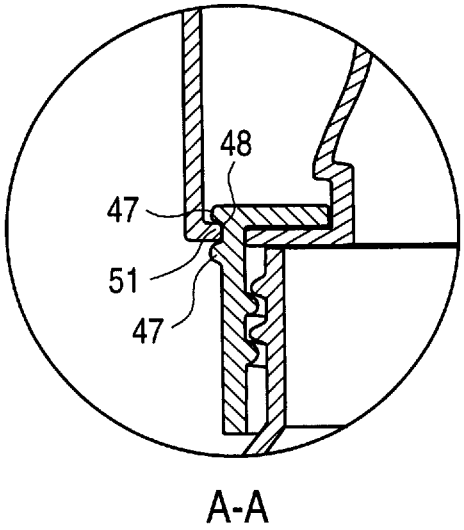
FIG. 11 is a cross section detail of the connection between the overcap and the collar.
Figure 14:
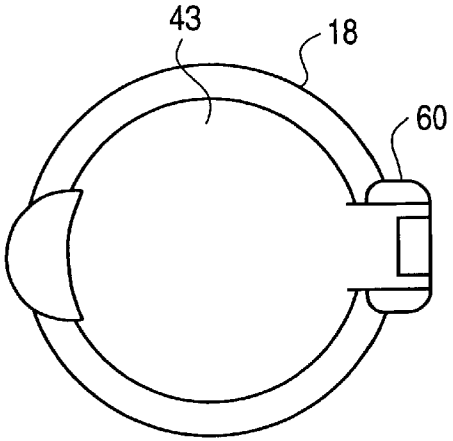
FIG. 14 is a top plan view of the overcap of FIG. 13.

Rib structure 51 is provided on the inner surface of overcap 18 for cooperation with the rib structure 47 on threaded collar 16 to releasably lock the overcap 18 in the first or closed, protective position. The rib structure for both the overcap and the collar could be either fully annular or segmented circumferentially or other means could be provided for a friction fit. To this end, FIGS. 1, 8 and 10 show a pair of ribs 47 which are on the outer surface of the collar 16 and are parallel with each other and form a gap 48 therebetween. In addition, the overcap has a rib, namely rib or annular rib 51 which is on the inner surface of the overcap 18 as shown in FIGS. 10 and 11. The rib 51 enters the gap 48 between ribs 47 on the collar as shown in FIGS. 10 and 11. Due to the resilience of the material of the overcap and the collar, the ribs of both parts yield so the singular rib 51 can snap into a portion of the gap 48 between ribs 47 and be securely held in place in a protective position of the nipple as shown in FIG. 10, with the nipple 14 completely concealed within the overcap 18 when the lid 43 covers the opening 41 as shown in FIG. 10.

In putting the assembly 10 together, nipple 14 is first placed on neck 20 of bottle 12, following which the collar 16 is threaded onto the neck 20 with nipple portion 31 projecting through opening 30 of the collar 16.

The overcap 18 is then placed over the nipple and onto the collar and moved into the position shown in FIG. 10. When this occurs, the rib 51 on overcap 18 engages with ribs 47 on collar 16. The overcap then slides downwardly until the gap 48 between ribs 47 on the collar 16 receive rib 51 on the overcap 18. When this occurs, the movement of the overcap is stable and the overcap is in the protective position covering the nipple. When this occurs, the nipple is covered or surrounded by the overcap 18 as shown in FIGS. 10 and 13 and the lid 43 can then be moved into the position closing the open top 41 on the overcap 18. As it closes the opening 41, lid 43 also receives the tip 23 of nipple 14 and presses against the hole 24 in the nipple, thereby providing a seal means which prevents leakage of liquids from the bottle as shown in FIGS. 10 and 13.

Figure 3A:
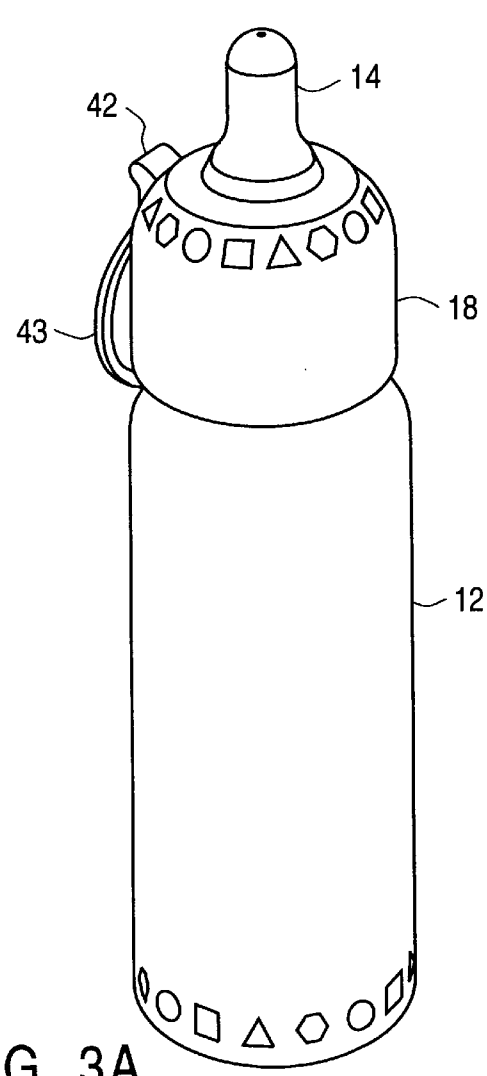
FIGS. 2A and 3A are perspective views of the embodiment of FIG. 1A showing the lids thereof being open to allow the nipple to project upwardly into operative positions.
Figure 2A:
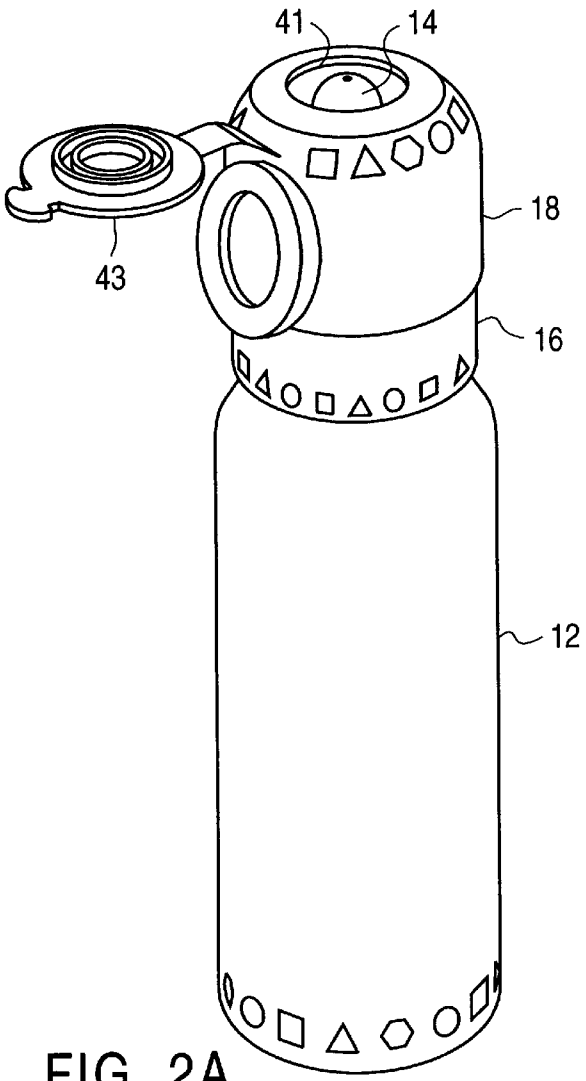

When it is desired to use the bottle and to dispense its contents, while keeping the overcap on the bottle, the lid is moved from its closed position as shown in FIG. 10 to the open position as shown in FIG. 2A, following which the overcap 18 is manually pushed axially downwardly allowing the rib 51 to leave the gap 48 as the overcap 18 exposes the nipple 14 for use and the overcap 18 then is in the covering position of the collar 16 as shown in FIG. 12. When this occurs, the overcap must stop because of the engagement of the underside of the overcap meeting with the upper side of the collar. When this occurs, the nipple is projecting through the opening of the overcap as shown in FIGS. 3A, 12 and 18. During this time, the lid can be retained by the recessed area 56 in the storing pad 58 on the side of the overcap 18 and the bottle can be used by a baby or child in the normal fashion.

After the contents have been partially or fully dispensed from the bottle, the overcap can be moved back into the position surrounding the nipple. This is achieved by pulling the overcap axially on the bottle in an upward motion. When this occurs, rib 51 will snap back into the gap 48 between ribs 47 on the collar 16 as shown in FIG. 10. The nipple will assume the position shown in FIG. 2A and the lid can be moved into a closed position covering the nipple thereby protecting the nipple, preventing leakage and storing the remainder of the contents while uniquely keeping the overcap on the bottle at all times. The bottle is then ready for storage or can be ready for reuse once again. To allow the baby to drink the remaining contents of the bottle simply go through the steps mentioned above for exposing the nipple to allow for use of the bottle once again.

For cleaning purposes, the user can pull the overcap with moderate force in an upward motion and rib 51 moves out of the space formed by ribs 47 and the overcap 18 will slide off the collar to allow for the complete disassembly of the entire unit, overcap, collar, nipple and bottle for the purpose of cleaning or refilling the bottle. The overcap assembly can then be placed back on the bottle for reuse as shown in the position shown in FIG. 10, the closed, protective position of the overcap 18 with respect to the nipple 14.

Figure 15:
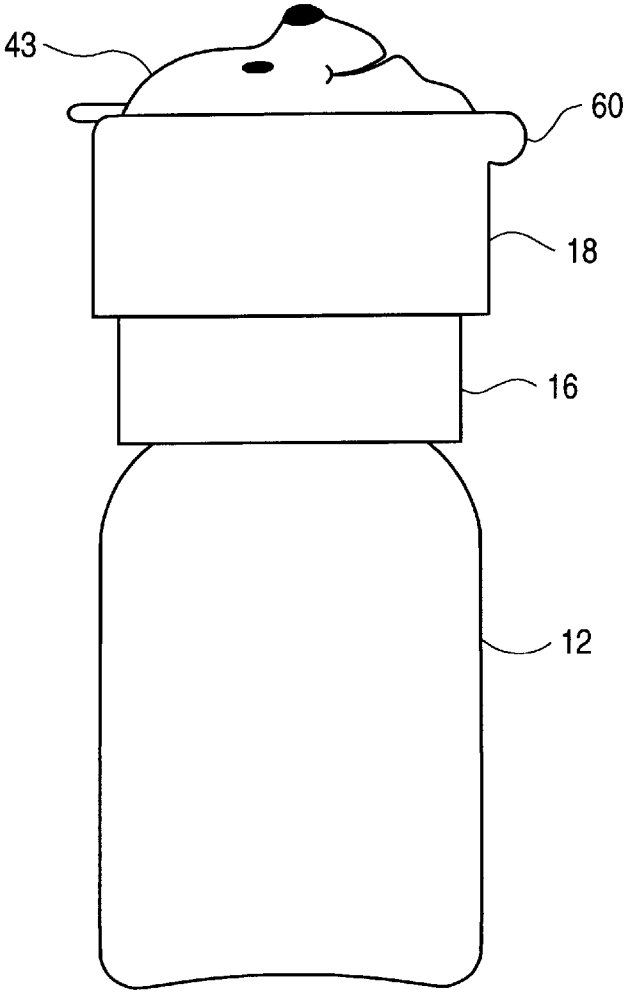

Although the description above contains many specificities, these should not be construed as limiting the scope of the invention but merely providing illustrations of some of the presently preferred embodiments of this invention. For example, the lid can have other shapes such as oval, triangular, or take on a 3-dimensional shape of an animal head or a sports ball or any other novelty shape as shown in FIGS. 15–16; the entire overcap can be formed in the shape of an animal head or a sports ball or any other novelty shape as shown in FIGS. 17 and 18; and decoration of any type could be added to the collar as shown in FIG. 7; the hinge could be of a variety of types such as, a living hinge, a swivel hinge, a strap hinge or a spring hinge, etc. as shown in FIGS. 7, 12 and 18, and the hinge could be molded as an integral part of the overcap and lid or as a connective part where the lid is assembled to the overcap as shown in FIGS. 7, 12 and 13; and the ribs on the collar and the overcap could be replaced by other methods of securely holding the overcap onto the collar such as segmented indentations, etc.

Figure 1A:
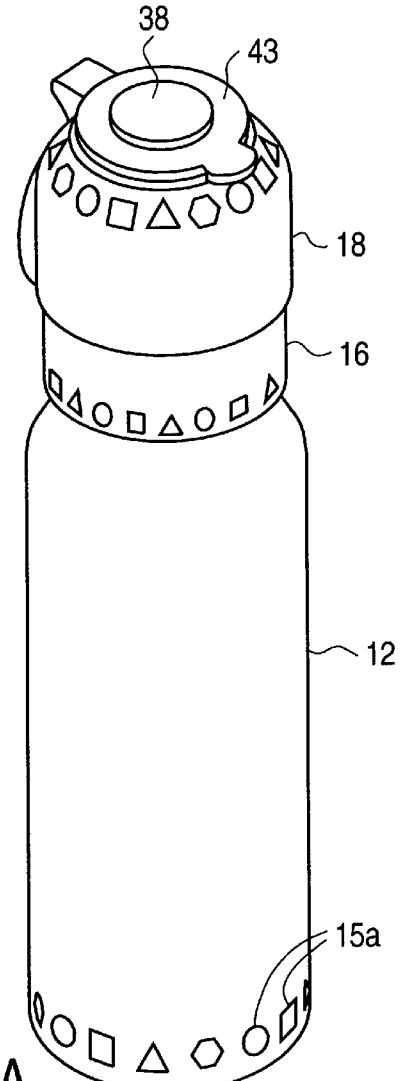
FIG. 1A is a perspective view of the embodiment of FIG. 1 mounted to a bottle and showing the lid in the closed position.

The overcap and the collar can be used on a variety of non-conventional shaped bottles as well. Some examples would be, bottles with the following shapes: rectangular, a doughnut shape (such as the ansa bottle), bottles bent on an angle (such as the Johnson's Healthflow) and many others of nonstandard shapes. In addition, the overcap and the collar can be used on bottles and juice cups of different sizes, shapes and diameters such as bottles that use disposable plastic liners and wide mouth bottles, etc. by simply enlarging or reducing the size and dimensions of the overcap and the collar to fit the container and the fluid dispenser of any type. The foregoing description has been made with respect to the universal assembly shown in FIG. 7. Other embodiments of the bottle assembly of the present invention are possible. A preferred embodiment is shown in FIG. 1A. Decorative indicia 15*a* or as shown in FIGS. 15–18 can be provided on the overcap assembly as desired.

The overcap and collar assembly of the present invention can be used with substantially all different types of commercially available bottles and nipples which are available for purchase and use at this time thus making this a very versatile universal assembly.

Thus, the scope of the invention should be determined by the appended claims and their legal equivalents, rather than by the examples given.

What is claimed is:

1. For use in combination with a fluid container of the type having a container opening, an overcap assembly comprising:

a collar securable to the fluid container at the container opening;

a fluid dispenser securable to the fluid container at the container opening by the collar, the fluid dispenser having a distal end extending away from said collar and said fluid container;

an overcap, having an over surface with an overcap opening formed therein, mounted to the collar for movement between a lower position on the collar for use and an upper position on the collar for storage;

said distal end of the fluid dispenser passing through said overcap opening when the overcap is in the lower position, said distal end of the fluid dispenser receding through the overcap opening when the overcap is in the upper position; and a lid removably mounted to the outer surface of the overcap to cover the overcap opening when the overcap is in the upper position.

2. The overcap assembly according to claim 1 wherein said collar has fluid container-engaging threads on an inner side wall of the collar and projections on an outer side wall of the collar with means for securing the overcap in upper and lower positions on the collar.

3. The overcap assembly according to claim 1 wherein said fluid dispenser includes a removable, reusable and replaceable baby bottle nipple having an opening at said distal end, said nipple being encapsuled in said overcap when said overcap is in the upper position, the lid is in the closed position and said nipple is in an upright position.

4. The overcap assembly according to claim 3 wherein said overcap and lid are sized and configured so that said lid sealingly engages said distal end of said nipple when said overcap is in the upper position and said lid is mounted to the outer surface of the overcap to cover the overcap opening.

5. The overcap assembly according to claim 1, wherein the overcap has an outer sidewall, and further comprising means for securing the lid to the outer sidewall of the overcap when said lid is removed from said overcap opening to prevent the lid from interfering with use of the fluid dispenser.

6. The overcap assembly according to claim 1 further comprising a tether connecting the lid to the overcap.

7. The overcap assembly according to claim 1 wherein the lid has means for stopping said fluid dispenser from dispensing liquid when the overcap is in the upper position and the lid is mounted to the outer surface of the overcap to cover the overcap opening.

8. The overcap assembly according to claim 1 wherein said collar has means for releasably retaining the overcap in the upper position on the collar for storage and the lower position on the collar for use.

9. The overcap assembly according to claim 1 wherein said fluid dispenser has a flange capturable between the collar and the fluid container.

10. For use in combination with a fluid container of the type having a container opening, an overcap assembly comprising:

a collar securable to the fluid container at the container opening;

a fluid dispenser securable to the fluid container at the container opening by the collar, the fluid dispenser having a distal end extending away from said collar and said fluid container;

an overcap, having a side and an overcap opening, mounted to the collar for movement between use and storage positions, said distal end of the fluid dispenser passing through said overcap opening when the overcap is in the use position;

a lid removably mounted to the overcap opening when the overcap is in the storage position; and means for biasing the lid against the side of the overcap when the lid is removed from said overcap opening.

11. For use in combination with a fluid container of the type having a container opening, an overcap assembly comprising:

a collar securable to the fluid container at the container opening;

a fluid dispenser securable to the fluid container at the container opening by the collar, the fluid dispenser having a distal end extending away from said collar and said fluid container;

an overcap, having an overcap opening, mounted to the collar for movement between use and storage positions, said distal end of the fluid dispenser passing through said overcap opening when the overcap is in the use position;

a lid removably mounted to the overcap opening when the overcap is in the storage position; and means for frictionally removably securing the lid to said overcap opening.

12. For use in combination with a fluid container of the type having a container opening, an overcap assembly comprising:

a collar securable to the fluid container at the container opening;

a fluid dispenser securable to the fluid container at the container opening by the collar, the fluid dispenser having a distal end extending away from said collar and said fluid container;

an overcap, having an overcap opening, mounted to the collar for movement between use and storage positions, said distal end of the fluid dispenser passing through said overcap opening when the overcap is in the use position;

lid removably mounted to the overcap opening when the overcap is in the storage position; and a hinge connecting the lid to the overcap.

13. For use in combination with a fluid container of the type having a container opening, an overcap assembly comprising:

a collar securable to the fluid container at the container opening;

a fluid dispenser securable to the fluid container at the container opening by the collar, the fluid dispenser having a distal end extending away from said collar and said fluid container;

an overcap, having an overcap opening, mounted to the collar for movement between use and storage positions, said distal end of the fluid dispenser passing through said overcap opening when the overcap is in the use position;

a lid removably mounted to the overcap opening when the overcap is in the storage position;

said collar having means for releasably retaining the overcap in the use and storage positions; and said releasably retaining means comprising parallel, interengaging ribs on the collar and the overcap.

14. For use in combination with a fluid container of the type having a container opening, an overcap assembly comprising:

a collar securable to the fluid container at the container opening;

a fluid dispenser securable to the fluid container at the container opening by the collar, the fluid dispenser having a distal end extending away from said collar and said fluid container;

an overcap, having an overcap opening, mounted to the collar for movement between use and storage positions, said distal end of the fluid dispenser passing through said overcap opening when the overcap is in the use position;

a lid removably mounted to the overcap opening when the overcap is in the storage position; and said overcap having a top wall provided with said overcap opening therethrough, said top wall having a lower surface, wherein said overcap has means for receiving the collar within the overcap, said collar having a top wall with a collar opening therethrough in alignment with said overcap opening, said collar having the means to receive the fluid dispenser through said collar opening, said top wall of the overcap being in overlying, substantially engaging relationship to the top wall of the collar when the overcap is in the use position.

15. For use in combination with a fluid container of the type having a container opening, an overcap assembly comprising:

a collar securable to the fluid container at the container opening;

a fluid dispenser securable to the fluid container at the container opening by the collar, the fluid dispenser having a distal end extending away from said collar and said fluid container;

an overcap, having an overcap opening, mounted to the collar for movement between use and storage positions, said distal end of the fluid dispenser passing through said overcap opening when the overcap is in the use position;

a lid removably mounted to the overcap opening when the overcap is in the storage position; and said overcap having a top wall and a relatively cylindrical sidewall integral with and depending from the top wall, said sidewall having inner and outer surfaces, a portion of the outer surface comprising means for receiving the lid when said lid is removed from said overcap opening, and further comprising an annular rib on the inner surface for engaging rib-engaging structure on the collar when the overcap is in either of said use or storage positions.

16. A fluid container comprising:

a bottle having a threaded neck;

a nipple adjacent to and aligned with the neck;

a collar threadably mounted on the neck of the bottle for coupling the nipple to the bottle, said collar having a top wall with a collar opening therein for passage of a part of the nipple therethrough;

an overcap mounted on the collar for movement along the collar from a first, nipple-protective leak-proof position to a second, nipple-enabling position, said overcap having a top wall with an overcap opening therein for passage of a portion of said nipple therethrough as the overcap moves from said first position to said second position relative to the collar;

means on the overcap and the collar for releasably holding the overcap in either of said first and second positions, the overcap adapted to substantially surround the nipple when in the first position, the overcap adapted to expose the nipple and enable the nipple for use when in the second position;

a user-removable lid mounted to the overcap opening, said lid sealably engaging said distal portion of said nipple to prevent leakage when the overcap is in the first position;

means for temporarily retaining said lid to the overcap outer side when said lid is removed from the overcap opening to prevent interference with use of the nipple; and the overcap, the collar and the nipple being removable from the bottle for cleaning and filling the bottle with a fluid.

17. The fluid container according to claim 16 further comprising means for coupling the overcap to the collar at substantially all times during use and storage.

18. The fluid container according to claim 16, wherein said releasably holding means includes a set of parallel ribs on said collar creating a groove and at least one rib on said overcap which is releasably received between said ribs on the collar.

19. The fluid container according to claim 16 wherein the collar has an outer sidewall, and wherein the releasably holding means comprises ribs on the outer sidewall engagable by the overcap.

20. A fluid container comprising:

a bottle having a threaded neck;

a nipple adjacent to and aligned with the neck;

a collar threadably mounted on the neck of the bottle for coupling the nipple to the bottle, said collar having a top wall with a collar opening therein for passage of a part of the nipple therethrough;

an overcap mounted on the collar for movement along the collar from a first, nipple-protective leak-proof upper position to a second, nipple-enabling lower position, said overcap having a top wall with an overcap opening therein for passage of a portion of said nipple therethrough as the overcap moves from said first, upper position to said second, lower position relative to the collar;

means on the overcap and the collar for releasably holding the overcap in either of said first and second positions, the overcap adapted to substantially surround the nipple when in the first, upper position, the overcap adapted to expose the nipple and enable the nipple for use when in the second, lower position;

a user-removable lid mounted to the overcap opening, said lid sealably engaging said distal portion of said nipple to prevent leakage when the overcap is in the first position; and the overcap, the collar and the nipple being removable from the bottle for cleaning and filling the bottle with a fluid.

* * * * *